US005320233A

United States Patent [19]

Welch

[11] Patent Number: 5,320,233

[45] Date of Patent: Jun. 14, 1994

[54] TAMPER EVIDENT LUG CAP

[75] Inventor: Bing Welch, Richmond, Ind.

[73] Assignee: Aluminum Company of America, Pittsburgh, Pa.

[21] Appl. No.: 114,001

[22] Filed: Aug. 30, 1993

[51] Int. Cl.[5] ..... B65D 41/34

[52] U.S. Cl. ..... 215/252; 215/331; 220/300; 220/301

[58] Field of Search ..... 215/252, 253, 254, 256, 215/329, 331, 332; 220/293, 295, 300, 301

[56] References Cited

U.S. PATENT DOCUMENTS 801,283 10/1905 Weissenthanner .
1,683,388 9/1928 Hammer .
2,000,407 5/1935 Miller .
3,165,220 1/1965 Haynes .
3,197,055 7/1965 Kelly .
3,460,703 8/1972 Ritzenhoff .
3,692,200 9/1972 Ritzenhoff .
4,241,842 12/1980 Toeppen .
4,560,076 12/1985 Boik .
4,700,860 10/1987 Li .
4,828,127 5/1989 Young .
5,103,991 4/1992 Collins .

*Primary Examiner*—Allan N. Shoap
*Assistant Examiner*—Nova Stucker
*Attorney, Agent, or Firm*—Dressler, Goldsmith, Shore, Sutker & Milnamow, Ltd.

[57] ABSTRACT

The present invention is directed to a lug cap or closure that is used in combination with a container for indicating that the container has been opened so as to indicate loss of seal or tampering. The lug cap includes an upper cap portion and a depending tamper or pilfer band, each having a series of circumferentially spaced lugs. The upper cap portion and the pilfer band are joined by a plurality of frangible bridges. The container finish includes combination camming/locking projections for locking the lugs into a locked position and for separating the pilfer band from the upper cap portion by a camming action when the container is opened. The lug cap may also include a secondary tamper indicating means such as a tamper indicating button in the top of the lug cap.

6 Claims, 2 Drawing Sheets

TAMPER EVIDENT LUG CAP

TECHNICAL FIELD OF THE INVENTION

The present invention relates generally to tamper evident lug caps for containers, and more particularly to a metal tamper evident lug cap including an upper cap portion and an integral pilfer band, each having lugs thereon which cooperate with a container finish to sever the pilfer band from the upper cap portion upon rotation of the lug cap.

BACKGROUND OF THE INVENTION

Caps or closures having tamper indicating devices for closing and sealing contents within containers are well known in the art. The tamper indicating devices are used to ensure consumer confidence and to deter tampering with the contents of a container.

Certain prior art caps or closures depend on a pop-out button in the center of the cap to show tampering or loss of seal. However, a consumer often has difficulty in determining whether this type of tamper indicating device has been triggered since the pop-out button can be difficult to see.

Other prior art containers incorporate the use of a closure having an upper cap portion with a depending separable pilfer band. In this type of construction, the features of the container finish for engaging the pilfer band are completely separate and distinct from those features of the finish (i.e., threads) for retaining the closure in place. This presents a disadvantage in that the pilfer band is not always severed by the rotation of the closure on the container.

The present invention is intended to overcome these disadvantages as well as to present several significant advantages.

SUMMARY OF THE INVENTION

This invention provides an improved lug cap for indicating that a container has been opened so as to indicate loss of seal or tampering. The lug cap includes an upper cap portion having a series of circumferentially spaced lugs. The closure further includes a depending tamper band or pilfer band, joined by a plurality of frangible bridges to the upper cap portion. The pilfer band also includes a series of circumferentially spaced lugs. The lugs on the pilfer band correspond in number to the lugs on the upper cap, thereby defining pairs of closure lugs, but each pilfer band lug is offset circumferentially a small distance relative to the respective lug of the upper cap portion.

For each of the pairs of the closure lugs, the container finish includes a combination camming/locking projection. Generally diverging camming surfaces are defined at one side of each projection, with the other side of each projection having stepped locking surfaces for respectively engaging the lugs on the upper cap portion and the lugs on the pilfer band.

During closure application, each pair of lugs is positioned in locking engagement with the stepped locking surfaces of a respective camming/locking projection. During closure removal, each pair of lugs is moved in a counterclockwise direction toward the diverging camming surfaces of the adjacent camming/locking projection, with engagement with the diverging surfaces acting to move the lugs apart, thus splitting the pilfer band from the upper cap portion as the lug cap is removed.

The lug cap of the present invention may include a secondary tamper indicating means such as a prior art tamper indicating pop-out button in the top wall of the lug cap. When the closure is opened, the tamper indicating button pops outwardly upon release of a negative pressure within the container, thus showing that the container seal has been broken.

This invention contemplates that the improved closure more clearly visually indicates that the container has been tampered with or that loss of seal has occurred than when a prior art pop-out button is the sole tamper indicating device used. This invention further contemplates that the improved closure, when used in combination with camming/locking projections on a container, more clearly indicates that the container has been tampered with or loss of seal has occurred than when a prior art separable pilfer band and container of the type described hereinabove is used.

These and other objects, features, and advantages of this invention are evident from the following description of a preferred embodiment of this invention with reference to the accompanying drawings.

DETAILED DESCRIPTION OF THE PREFERRED EMBODIMENT

Figure 1:
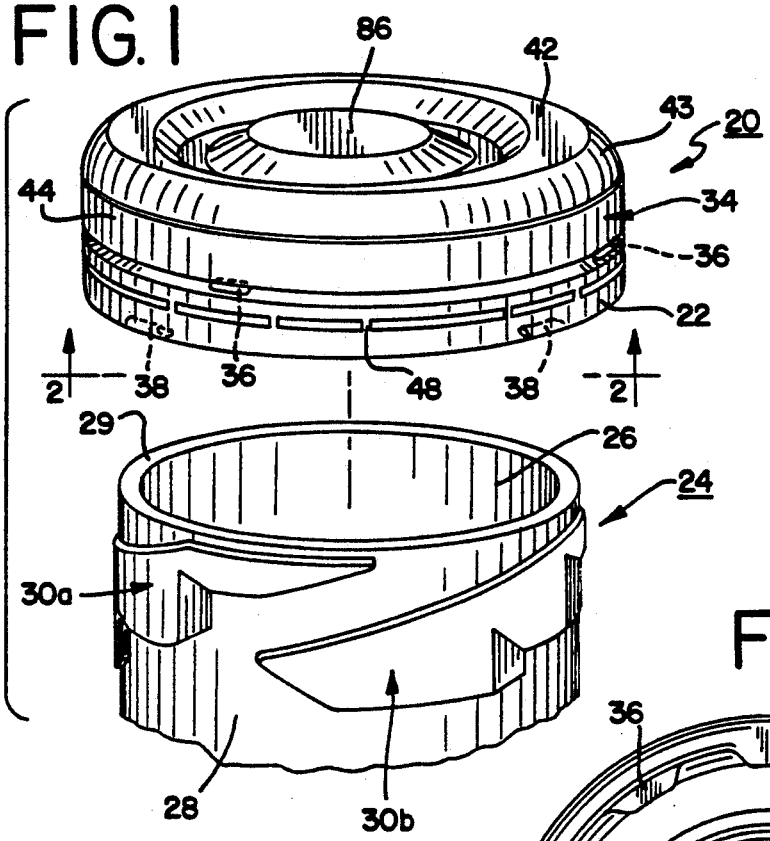
FIG. 1 is a perspective view of a lug cap or closure illustrating a skirt portion and a tamper or pilfer band and a complementary container according to the present invention.

While the present invention is susceptible of embodiments in various forms, there is shown in the drawings and will hereinafter be described a presently preferred embodiment, with the understanding that the present disclosure is to be considered as an exemplification of the invention, and is not intended to limit the invention to the specific embodiment illustrated.

As shown in the drawings, a closure or lug cap 20 having an integral, separable tamper or pilfer band 22 for application to a container 24 constitutes a preferred embodiment of this invention. As illustrated in FIG. 1, the container 24 is of a well known construction having an open mouth 26, a neck 28 terminating in an annular rim 29 and a body (not shown). The container 24 is used to holds contents (not shown), such as a liquid, therein. The container 24 may be made of glass, plastic and the like. The container 24 includes camming/locking projections 30*a*, 30*b*, 30*c* (partially shown in FIG. 7) the function of which will be described in detail herein.

The lug cap or closure 20 is preferably made of a metal material, for example tin plate or aluminum. However, the lug cap 20 may also be made of a plastic material without departing from the scope of this invention.

Figure 2:
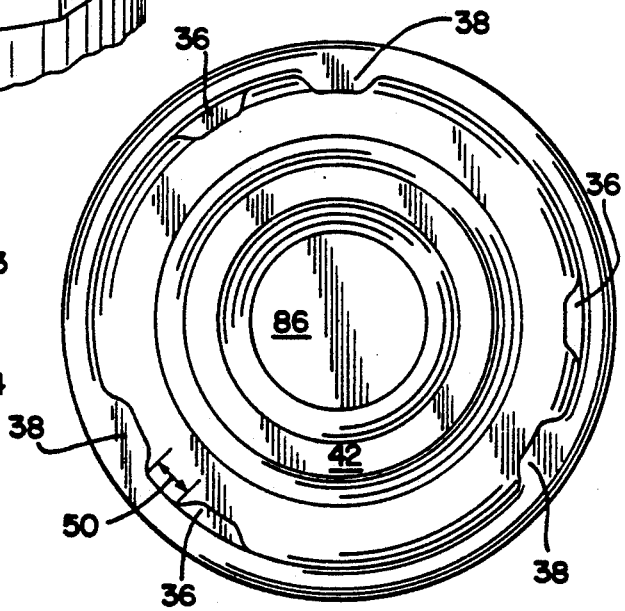
FIG. 2 is a bottom plan view of the inside of the lug cap according to the present invention.
Figure 4:
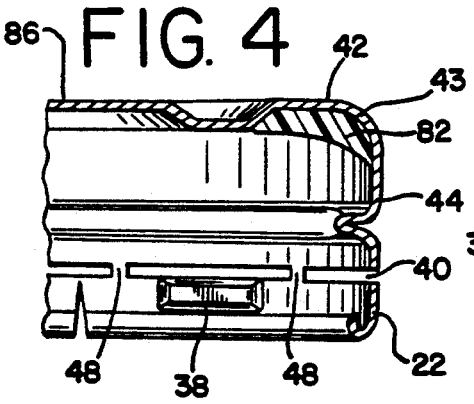
FIG. 4 is a partial cross-sectional view of the lug cap showing a series of lugs in a second embodiment.
Figure 3:
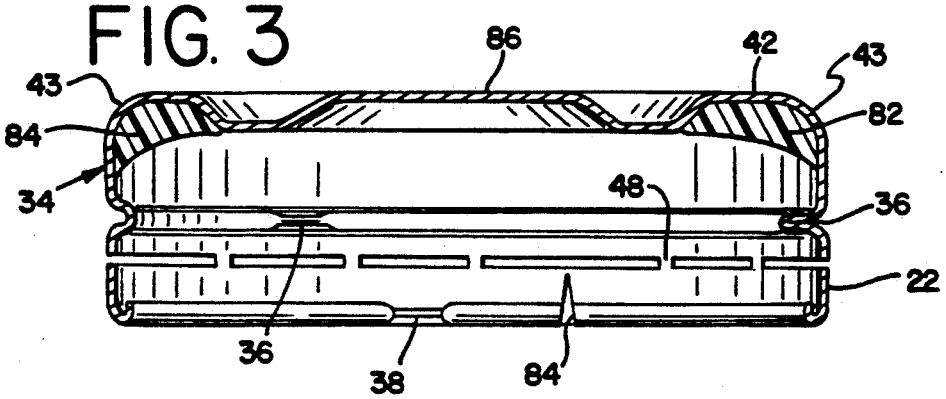
FIG. 3 is a cross-sectional view of the lug cap showing a series of lugs in a first embodiment.

The lug cap 20 is placed over the open mouth 26 of the container 24 and around an upper end portion 32 of the neck 28 thereby closing the mouth 26 and sealing the contents of the container 24 therein. The lug cap 20, as illustrated in FIGS. 2–4, includes an upper cap portion 34 having a plurality of series of inwardly protruding upper lugs 36 and a depending integral pilfer band 22 having a plurality or series of inwardly protruding lower lugs 38. The interiors of the upper cap portion 34 and the pilfer band 22 are generally smooth except where the lugs 36, 38 protrude inwardly. When the upper and lower lugs 36, 38, respectively, contact the neck 28 of the container 24, the lugs 36, 38 secure the lug cap 20 onto the neck 28 of the container 24. The pilfer band 22 is partially separated from the upper cap portion 34 by a score line 40.

The upper cap portion 34 of the closure 20 includes a top wall portion 42, a rounded shoulder 43 and an annular skirt portion 44 depending from the shoulder 43. The series of upper lugs 36 extend inwardly from the annular skirt portion 44 and are circumferentially spaced around the annular skirt portion 44. The upper lugs 36 engage the upper end 34 of the container neck 28.

The integral annular pilfer band 22, when severed, indicates that the container 24 has been tampered with or previously opened. The pilfer band 22 depends from the bottom end of the annular skirt portion 44 of the upper cap portion 34 and is attached to the upper cap portion 34 by a plurality of frangible bridges 48 that connect the pilfer band 22 to the upper cap portion 34 across the score line 40. The frangible bridges 48 are severed upon rotation of the lug cap 20 so as to indicate tampering or loss of seal.

The lower lugs 38 project inwardly from the annular pilfer band 22. The lower lugs 38 are circumferentially spaced and engage the upper end portion 32 of the container neck 28.

The lugs 38 of the pilfer band 22 correspond in number to the lugs 36 of the upper cap portion 34 thereby defining pairs or sets of lugs 36, 38. Three pairs of lugs 36, 38 are shown in the drawings, however, it is to be understood that a greater number or fewer pairs of lugs may be used without departing from the scope of the invention. Each upper lug 36 is offset circumferentially by a small distance 50 relative to the respective lower lug 38.

As shown in FIG. 3, each upper and lower lug 36, 38, respectively, may be made in the form of a collapsed bead. In this form, the lugs 36, 38 are formed by collapsing points along the exterior of the annular skirt portion 44 and pilfer band 22 inwardly, by appropriate means, to form a roll groove. Thereafter, pressure is applied to the top wall portion 42 of the lug cap 20, by appropriate means, a sufficient amount to form a deformation having inclined walls that generally meet at a point.

As shown in FIG. 4, the upper lugs 36 are made in the collapsed bead form while the lower lugs 38 are made in the form of a swaged projection. The collapsed beads are formed as described above. The swaged projections are formed by collapsing the points along the exterior of the pilfer band 22 inwardly, by appropriate means, to form a deformation having four inwardly, inclined walls with a generally flat inner surface. It is to be understood that the upper or lower lugs 36, 38, respectively, may be made in the collapsed bead form or in the swaged projection form, in any combination, without departing from the scope of this invention. In the collapsed bead form, the point of the lug 36, 38 contacts the neck 28 of the container 24 while in the swaged projection form, the inner surface contacts the neck 28 of the container 24.

For each of the pairs of closure lugs 36, 38, the container finish, i.e. the exterior of the container 24, includes a combination camming/locking projection 30*a*, 30*b*, 30*c* spaced circumferentially around the upper end portion 32 of the neck 28 of the container 24. One side of each projection 30*a*, 30*b*, 30*c* has generally diverging camming surfaces 72, 74 having a top inclined ramped surface 72 and bottom inclined ramped surface 74. The ramped surfaces 72, 74 meet generally at an apex 76. The top ramped surface 72 inclines upwardly and rearwardly from the apex 76 while the bottom ramped surface 74 inclines downwardly and rearwardly from the apex 76. The other side of each projection 30*a*, 30*b*, 30*c* has stepped locking surfaces 78, 80 for respectively engaging the upper 36 and lower 38 lugs of each pair. Each locking surface 78, 80 is preferably of a sufficient length to contact the entire length of each lug 36, 38. Thus, each lug 36, 38 is securely held within the stepped locking surfaces 78, 80 and will not move out of position until the lug cap 20 is rotated.

Figure 5:
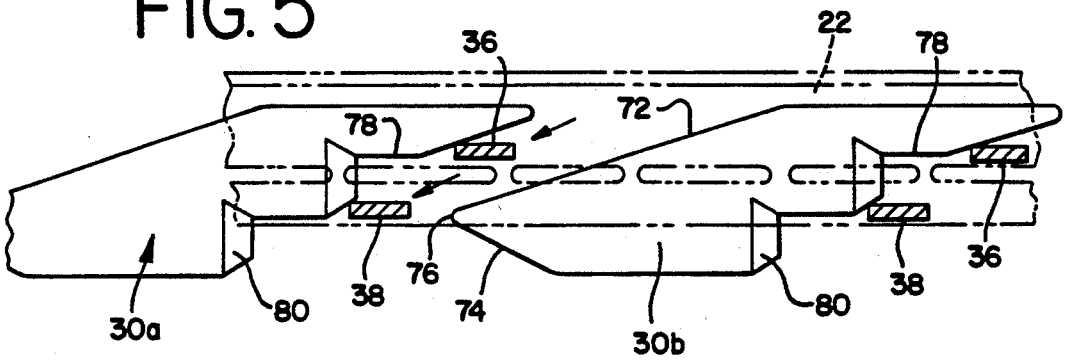
FIG. 5 is a diagrammatic view of the camming/locking projections on the container and a diagrammatic view of the lug cap shown in phantom with the lugs in a generally starting position.
Figure 6:
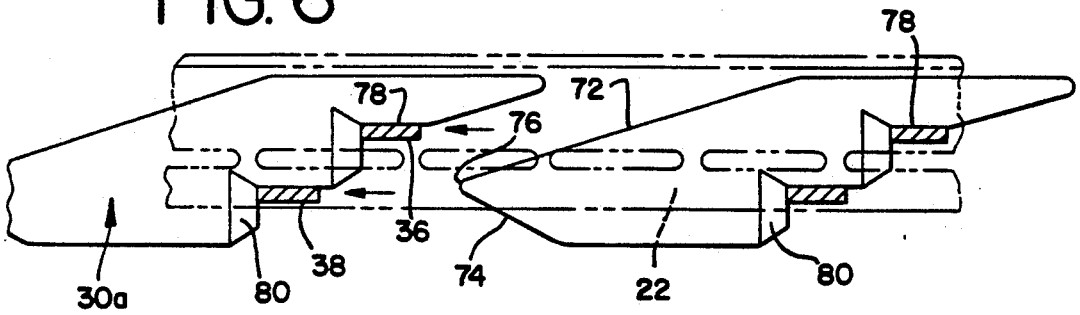
FIG. 6 is a diagrammatic view similar to FIG. 5 with the lugs on the lug cap illustrated in a locked position.

As shown in FIG. 5, when the lug cap 20 is placed onto the container 24, each pair of lugs 36, 38 is generally positioned between the top ramped surface 72 of one projection 30*b* and the stepped locking surfaces 78, 80 of the next projection 30*a*. To close the lug cap 20 onto the neck 28 of the container 24, a downward force is applied to the lug cap 20 while the lug cap 20 is rotated, preferably in the clockwise direction. Since a downward force is applied as the lug cap 20 is rotated, the pairs of lugs 36, 38 travel between the top ramped surface 72 of one projection 30*b* and the stepped locking surface 78, 80 of the next projection 30*a* until the top wall portion 42 or a sealing liner 82, if one is used, of the lug cap 20 sealingly contacts the annular rim 29 of the container 24. Thereafter, the lugs 36, 38 are rotated into the locked position, as illustrated in FIG. 6, by positioning each pair of lugs 36, 38 in locking engagement with the stepped locking surfaces 78, 80 of a respective camming/locking projection 30*a*, 30*b*.

Figure 7:
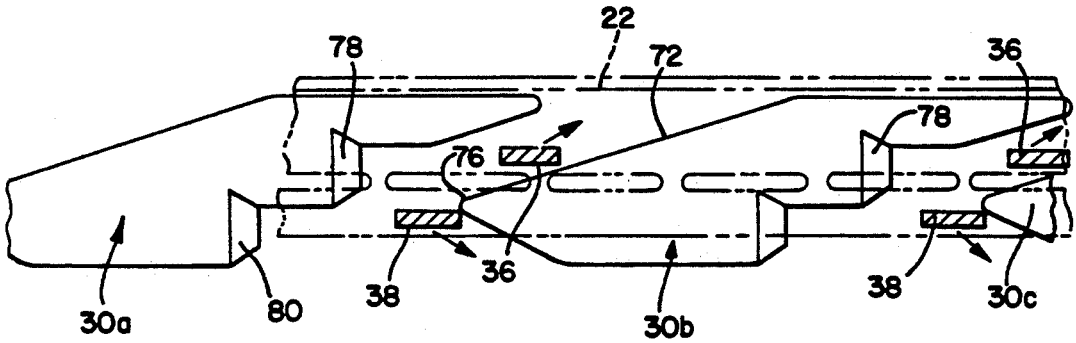
FIG. 7 is a diagrammatic view similar to FIGS. 5 and 6 illustrating how the lugs are split by the camming/locking projections to sever the pilfer band from the skirt portion.

To remove the lug cap 20, each pair of lugs 36, 38 is moved in a direction opposite to that taken to apply the lug cap 20, preferably in a counterclockwise direction, toward the diverging camming surfaces 72, 74 of the adjacent camming/locking projection 30*b*. As shown in FIG. 7, when the pairs of lugs 36, 38 contact a respective diverging camming surface 72, 74, the diverging camming surfaces 72, 74 act to move the lugs 36, 38 apart. That is, the lower lug 38 travels along the bottom ramped surface 74 while the upper lug 36 travels along the top ramped surface 72. Once the upper 36 and lower 38 lugs move a sufficient distance apart, the frangible bridges 48 on the pilfer band 22 sever and the pilfer band 22 splits from the upper cap portion 34 as the lug cap 20 is removed.

The lug cap 20 may also include a sealing liner 29, as previously mentioned herein, positioned adjacent the top wall portion 42 to tightly seal the lug cap 20 onto the open mouth 26 of the container 24. The sealing liner 29 may be made of a well known material, such as plastisol.

Now that the specifics of the lug cap 20 have been described in detail hereinabove, the method for forming the lug cap 20 will be generally described. First, the top wall portion 42 and an integral annular side wall are formed out of a sheet of material by appropriate means, such as stamping. The upper 36 and lower 38 lugs are then formed by means as described hereinabove. The bottom portion of the lug cap 20 is then rolled to form a curl. Thereafter, to form the pilfer band 22 and the skirt portion 44, the side wall is partially cut to form score line 40 while leaving the frangible bridges 48, along the circumference of the annular side wall. Finally, the sealing liner 82 is added. The lug cap 20 is now ready to be affixed to the container 24.

One feature of note that may be included in the lug cap 20 construction is a residual score 84 on the pilfer band 22, as illustrated in FIG. 3. The residual score 84 is used to facilitate removal of the pilfer band 22 from the container 20 after the pilfer band 22 has been severed from the upper cap portion 34 by the above described method. To form the residual score 84, the pilfer band 22 is partially cut in a direction perpendicular to the bottom edge of the pilfer band 22, by appropriate means, to form a slit. The residual score 84 enables a user to split the pilfer band 22 by pulling on the opposite sides of the residual score 84 thereby splitting the pilfer band 22. Thereafter, the pilfer band 22 may be removed from the container 20.

Alternatively, the pilfer band 22 may be removed from the container 24 by rotating the intact pilfer band 22. To do this, a user rotates and pulls the pilfer band 22 upward in such a manner that the lugs 36, 38 travel between the diverging ramped surfaces 72, 74 of one projection **30*b* and the stepped locking surfaces 78, 80 of the next projection 30*a***.

Another feature of note is that the lug cap 20 may include a depressed tamper proof button 86 located generally in the center of the top wall portion 42. This type of tamper indicating means is well known in the art and will not be described in detail herein. Generally, when the lug cap 20 is rotated, the seal that the liner 82 forms with the rim 29 of the container 24 is broken allowing air to be introduced within the lug cap 20. Thereafter, the button 86 pops outwardly indicating that tampering or loss of seal has occurred.

From the foregoing, it will be observed that numerous modifications and variations can be effected without departing from the true spirit and scope of the novel concept of the present invention. It is to be understood that no limitation with respect to the specific embodiments is intended or should be inferred. The disclosure is intended to cover by the appended claims all such modifications as fall within the scope of the claims.

The invention claimed is:

1. A package arrangement, comprising:

a closure including an upper closure cap having a top wall portion and a depending skirt portion, and an annular pilfer band depending from and detachably connected to said skirt portion of said closure cap; and a container having an open mouth defined by a neck portion thereof to which said closure can be applied for closing said mouth, said closure including a plurality of upper lugs extending inwardly of said skirt portion for engagement with said container neck portion, and a plurality of lower lugs extending inwardly of said pilfer band for engagement with said container neck portion, said container neck portion including at least one camming/locking projection on the exterior thereof, said at least one camming/locking projection defining a pair of locking surfaces for respectively receiving a first pair of lugs, including one of said upper lugs and one of said lower lugs, when said closure is applied to said container, said at least one camming/locking projection further including at least one camming surface engageable with one of said lower lugs during removal of said closure from said container for separating said pilfer band from said closure cap.

2. A package arrangement in accordance with claim 1, wherein said at least one camming/locking projection includes a pair of diverging camming surfaces for respectively engaging a second pair of lugs, including another one of said upper lugs and another one of said lower lugs, during removal of said closure from said container.

3. A package arrangement in accordance with claim 2, wherein said locking surfaces of said at least one camming/locking projection are arranged in a relatively vertically and circumferentially spaced, stepped configuration, said upper and lower lugs of each said pair being positioned in circumferentially spaced relationship to correspond to the stepped configuration of said locking surfaces.

4. A package arrangement in accordance with claim 1, wherein said closure includes a sealing liner positioned adjacent the top wall portion of said closure cap.

5. A tamper-indicating closure for a container, comprising:

a metallic upper closure cap having a top wall portion, and an annular skirt portion depending therefrom, said closure cap including a plurality of circumferentially spaced lugs extending integrally inwardly from said skirt portion for engagement with said container; and a metallic tamper-indicating pilfer band formed integrally with said closure cap and detachably joined thereto by a plurality of frangible bridges joining said pilfer band to said skirt portion, said closure including a plurality of upper lugs and a plurality of lower lugs respectively extending inwardly of said skirt portion and said pilfer band, said upper and lower lugs being arranged in circumferentially spaced pairs, where the lower lug of each pair is vertically and circumferentially spaced from the respective upper lug by a predetermined dimension, said pairs of lugs being configured for cooperation with said container for securing said closure in position thereon, and for separating said pilfer band from said skirt portion during removal of said closure from said container.

6. A tamper-indicating closure in accordance with claim 5, wherein each of said upper and lower lugs comprises an inwardly deformed portion of the respective metallic closure cap and metallic pilfer band.

* * * * *